US008561552B2

(12) United States Patent
Chang

(10) Patent No.: US 8,561,552 B2
(45) Date of Patent: Oct. 22, 2013

(54) FOLDABLE TABLE WITH ANTI-TORSION ARRANGEMENT

(76) Inventor: Mei-Fang Chang, Taipei (TW)

( * ) Notice: Subject to any disclaimer, the term of this patent is extended or adjusted under 35 U.S.C. 154(b) by 86 days.

(21) Appl. No.: 12/655,824

(22) Filed: Jan. 7, 2010

(65) Prior Publication Data

US 2010/0170423 A1 Jul. 8, 2010

(30) Foreign Application Priority Data

Jan. 7, 2009 (CN) ..... 2009 1 0003140

(51) Int. Cl.
*A47B 3/00* (2006.01)
*A47B 3/083* (2006.01)

(52) U.S. Cl.
USPC ..... 108/132; 108/169

(58) Field of Classification Search
USPC ..... 108/132, 129, 167, 169, 168, 126, 130, 108/131, 166, 174
See application file for complete search history.

(56) References Cited

U.S. PATENT DOCUMENTS 2,474,450 A * 6/1949 Woodruff ..... 108/132
2,643,926 A * 6/1953 Pucci ..... 108/131
2,747,957 A * 5/1956 Lencioni ..... 108/36
2,784,042 A * 3/1957 Clapper ..... 108/132
3,416,468 A * 12/1968 Peterson et al. ..... 108/131
3,661,100 A * 5/1972 Tennant ..... 108/132
3,818,844 A * 6/1974 Burr ..... 108/132
4,111,482 A * 9/1978 Jones ..... 297/158.4
4,686,910 A * 8/1987 Skjerseth ..... 108/118
6,615,743 B2 * 9/2003 Nien ..... 108/132
6,752,091 B2 * 6/2004 Glover et al. ..... 108/168
2005/0061214 A1 * 3/2005 Tsai ..... 108/132
2007/0056485 A1 * 3/2007 Tsai ..... 108/169

* cited by examiner

*Primary Examiner* — Janet M Wilkens
*Assistant Examiner* — Timothy M Ayres
(74) *Attorney, Agent, or Firm* — Raymond Y. Chan; David and Raymond Patent Firm

(57) ABSTRACT

A foldable table includes a table top, two leg frames foldably coupling with a bottom side of the table top, and a torsion resistance frame including two longitudinal side frames parallelly provided along two longitudinal side portions of the table top respectively, and two lateral side reinforcing members laterally extended between the longitudinal side frames at two lateral side portions of the table top to form an anti-torsion frame for encircling with a peripheral portion of the table top. The torsion resistance frame is integrated with the bottom side of the table top, making it a one-piece table frame structure with increased rigidity at its maximum level, resistance to the external force of torsion and distortion. The table, having the maximum utility with minimum materials, has increased durability, comfort in usage and convenience for transportation and has lowered energy consumption in the manufacture of household furniture.

6 Claims, 7 Drawing Sheets

FOLDABLE TABLE WITH ANTI-TORSION ARRANGEMENT

BACKGROUND OF THE PRESENT INVENTION

1. Field of Invention

The present invention relates to a table structure, and more particularly to a table structure which includes a table top and a foldable frame arrangement enhancing the rigidity of the table top and the torsion-resistance on the table top.

2. Description of Related Arts

Conventional household furniture, such as dinning table, conference table or other types of work station, etc., in which its table top is made of wood or synthetic wood plank, has the advantageous of being substantively rigid and durable. In particularly, the one important feature of this kind of table which is integrally constructed is that the table is highly resistant to torsion. However, the use of wood plank in this kind of table has the following disadvantages: the material wood plank is heavy, inconvenience for storage and transportation, and has high consumption of wood materials.

Household furniture makes use of contemporary technologies to enable the use of light materials such as plastic for the table top. The use of plastic table top can lower the weight and hence convenience for transportation, however, the rigidity and stability of the table top will be significantly decreased because the strength of this type of plastic table top is very weak. In order to solve the problems and provide sufficient strength to the table top, an additional supporting structure made of metal has to be provided under the table top. Therefore, the cost of manufacture is highly increased and the convenience for transportation is lowered. In addition, since the contemporary technologies generally make use of movable connecting frame for support, such as U.S. Pat. No. 6,112,674 in which the table top is made of plastic, the leg poles of the supporting structure are mounted to the table frame at the bottom of the table top in a movable manner. Since the table frame is located at the bottom of the table top, the supporting structure and the table frame are mounted and positioned in an unsecured manner, thus the supporting structure and the supporting frame do not provide an integral structure to provide protection against the force of torsion while the mounting of supporting structure and supporting frame onto the bottom of the inherently weak table top cannot increase the resistance of the table against torsional force on the table top. This drawback in relation to the effect of torsion becomes prominent and uncovered when the table as a whole is being moved or when a relatively great external force is imposed onto the table top.

SUMMARY OF THE PRESENT INVENTION

An object of the present invention is to solve the problems of conventional table as described above, to provide a support structure for in a one-piece integrated table frame securely mounted in the bottom of a table top, such that the one-piece table frame can increase the rigidity at its maximum level, so as to resisting to the external force of torsion and protecting the table top from distortion. Another object of the present invention is to provide a foldable table with the maximum utility by using the minimum quantity of materials which has increased durability, comfort in usage and convenience for transportation, that the foldable table has lowered energy consumption in the manufacture of household furniture.

Accordingly, in order to accomplish the above objects, the present invention provides a foldable table comprising a table top and a leg frame for supporting the table top at the bottom side thereof. The foldable table further comprises a torsion resistance frame rigidly coupling between the table top and the leg frame for resisting an external force of torsion exerted at the table top.

The foldable table further comprises a leg folding arrangement which is provided between the table top and the leg frame such that the leg frame can be folded to its unfolded position and folded position and is incorporated with the torsion resistance frame such that the table top is resistant to the external force of torsion.

The torsion resistance frame comprises two longitudinal side frames provided two longitudinal side portions of the table top at the bottom side thereof respectively, and two lateral side reinforcing members laterally extended between the outer ends of the longitudinal side frames to form an anti-torsion frame for encircling with the peripheral portion of the table top.

The torsion resistance frame further comprises a mid-support arrangement.

The mid-support arrangement comprises a longitudinal mid-support member extended between the corresponding lateral side reinforcing members. Each of the rotating members has a receiving groove provided at the mid-portion thereof such that when the rotating members are rotatably coupled with the lateral side reinforcing members respectively, the longitudinal mid-support member can connect to the corresponding lateral side reinforcing members at the receiving grooves of the rotating members.

Another object of the present invention is that the table top comprises two top units foldably coupled with each other such that the table top can be pivotally folded in half. The two leg frames are supported at the two top units respectively. The foldable table further comprises a leg folding arrangement coupling between the table top and the leg frame for enhancing the folding structure of the leg frame to fold the leg frame between an unfolded position and a folded position. The torsion resistance frame is provided at the bottom side of the table top for resisting the external force of torsion exerted at the table top and protecting the table top from distortion. The torsion resistance frame comprises a tabletop folding arrangement incorporating with the longitudinal side frames to enable the table top being folded in half by pivotally overlapping the two top units with each other and being unfolded to align the two top units edge-to-edge.

The tabletop folding arrangement comprises a first connector provided at the corresponding inner end of each of the first and second longitudinal side reinforcing members, and a second connector pivotally coupling two corresponding first connectors with each other so as to pivotally connect the first and second longitudinal side reinforcing members end-to-end.

The torsion resistance frame further comprises a mid-support arrangement.

The mid-support arrangement comprises two lateral mid-support members laterally extended between the inner ends of the first and second longitudinal side reinforcing members. Preferably, each of the lateral mid-support members is coupled with two corresponding first connectors at the inner ends of the first and second longitudinal side reinforcing members. The torsion resistance frame further comprises two lateral side reinforcing members which are laterally extended between the outer ends of the first and second longitudinal side reinforcing members and are extended parallelly to the first and second lateral mid-support members. Each of the leg frames comprises a rotating member rotatably coupling with the corresponding lateral side reinforcing member, wherein the rotating member is coaxially coupling with the corresponding lateral side reinforcing member to enable the rotating member being rotated with respect to the lateral side reinforcing member. The mid-support arrangement further comprises two longitudinal mid-support members extended between the corresponding lateral side reinforcing members and the lateral mid-support members.

The two top units of the table top are supported by the torsion resistance frame, wherein the longitudinal side reinforcing members are parallelly extended with each other and are longitudinally extended along two longitudinal side portions of the two top units at the bottom side thereof to reinforce the table top at two longitudinal sides thereof. The lateral side reinforcing members are laterally extended between the outer ends of the longitudinal side reinforcing members, wherein the lateral side reinforcing members not only reinforce the two outer lateral sides of the table top but also enable the rotating members being rotatably coupled underneath the table top. Accordingly, when the rotating members are rotatably coupled with the lateral side reinforcing members respectively, the longitudinal mid-support members can connect to the lateral side reinforcing members at the receiving grooves of the rotating members. The two top units of the table top are foldably coupled with each other through the tabletop folding arrangement. Accordingly, the two longitudinal side reinforcing members are pivotally connected end-to-end through the tabletop folding arrangement, such that the table top can be pivotally folded in half by overlappedly folding the two top units with each other. In addition, the two lateral mid-support members are laterally extended between two inner ends of the longitudinal side reinforcing members at a position that the lateral mid-support members are laterally extended along the two inner lateral sides of the table top to reinforce the structure of the table top.

The present invention has the following advantages over the contemporary technology:

1. The foldable table of the present invention provides direction to the table frame design in the bottom portion of the table top for improvement, such that the foldable table has an increased level of sturdiness, the connection between elements of the folding arrangement and the leg folding arrangement are concrete and strong which is not easy to break, especially by the application of external force of torsion.

2. The foldable table of the present invention can carry a greater weight or loading at the table top.

3. The foldable table of the present invention not only can save the use of materials, such as wood or synthetic wood plank and energy during manufacture, but also increase the durability, comfort in usage and convenience for transportation of the foldable table.

These and other objectives, features, and advantages of the present invention will become apparent from the following detailed description, the accompanying drawings, and the appended claims.

DETAILED DESCRIPTION OF THE PREFERRED EMBODIMENT

Figure 1:
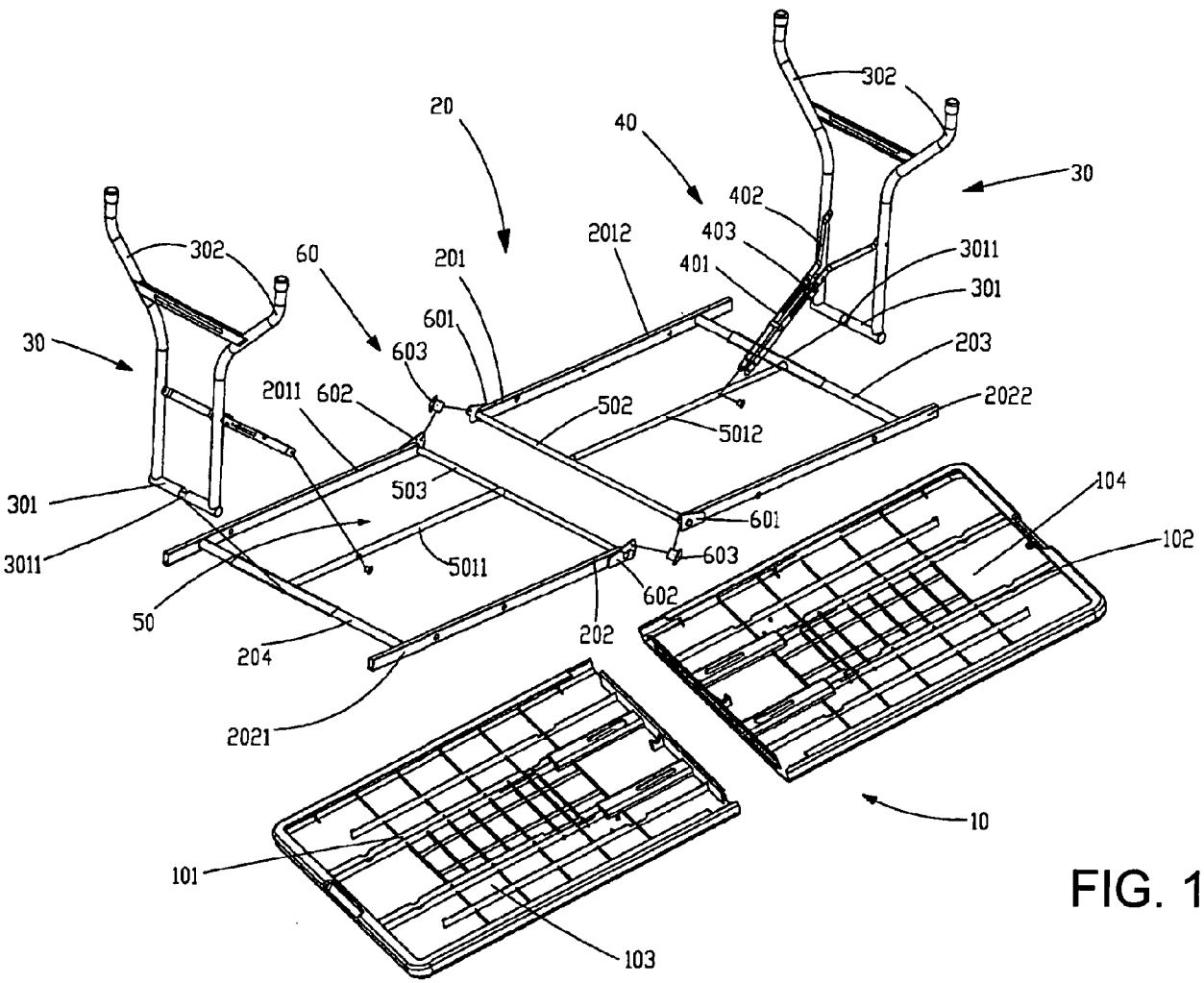
FIG. 1 is an exploded perspective view of the foldable table with anti-torsion arrangement according to a first preferred embodiment of the present invention.
Figure 2:
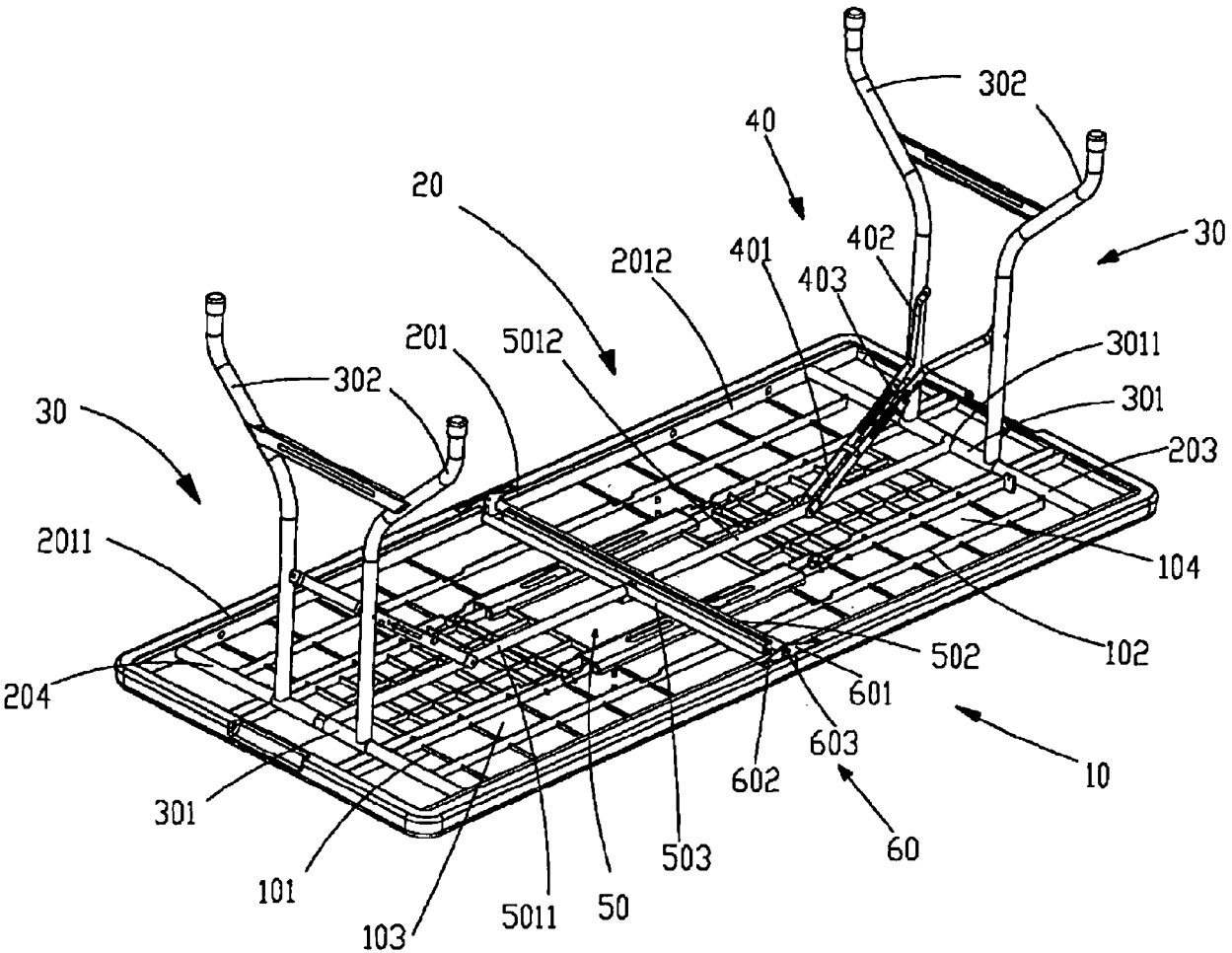
FIG. 2 is a bottom perspective view of the foldable table with anti-torsion arrangement according to the first preferred embodiment of the present invention.

Referring to FIGS. 1 and 2 of the drawings, a foldable table, which is resistance to the force of torsion, according to a first preferred embodiment of the present invention is illustrated.

The foldable table according to the first preferred embodiment of the present invention comprises a plastic made table top 10 defining a first top unit 103 and a second top unit 104 preferably identical to the first top unit 103, a leg frame 30 foldably supported underneath each of the first and second top units 103, 104 of the table top 10, a leg folding arrangement 40 provided between the table top 10 and the leg frame 30 to guide the leg frame 30 being folded between a folded position and an unfolded position.

The foldable table further comprises a torsion resistance frame 20 rigidly coupled at the table top 10 for resisting to the external force of torsion exerted at the table top 10, wherein the torsion resistance frame 20 is embedded into the bottom side of the tablet top 10. Accordingly, the table top 10 has a plurality of pre-arranged indentation grooves provided at the bottom side for the torsion resistance frame 20 being embedded thereat.

The torsion resistance frame 20 comprises two longitudinal side frames provided at the first top unit 103 and the second top unit 104 respectively. Each of the longitudinal side frames comprises first and second longitudinal side reinforcing members 2011, 2012, 2021, 2022 longitudinally coupling at two longitudinal side portions of each of the first and second top units 103, 104 at the bottom side thereof. In other words, one pair of the first and second longitudinal side reinforcing members 2011, 2021 are coupled at the first top unit 103 while another pair of first and second longitudinal side reinforcing members 2012, 2022 are coupled at the second top unit 104. Accordingly, the first longitudinal side reinforcing members 2011, 2012 are pivotally coupled with each other end-to-end by a tabletop folding structure 60. In addition, the second longitudinal side reinforcing members 2021, 2022 are pivotally coupled with each other end-to-end by the tabletop folding structure 60. Therefore, the first and second top units 103, 104 can be pivotally folded in an overlapped manner via the pivot structure 60 and can be unfolded to align the top side of the first top unit 103 with the top side of the second top unit 104 to form a flat top supporting surface of the table top 10.

The tabletop folding arrangement 60 comprises a first connector 601, 602 provided at the corresponding inner end of each of the first and second longitudinal side reinforcing members 2011, 2012, 2021, 2022, and a second connector 603 pivotally coupling two corresponding first connectors 601, 602 with each other so as to pivotally connect the first and second longitudinal side reinforcing members 2011, 2012, 2021, 2022 end-to-end. Preferably, the first connector 601, 602 is a hinge plate having a through hole. The second connector 603 is a rivet pivotally coupling two hinge plates through the through holes.

The torsion resistance frame 20 further comprises a mid-support arrangement 50.

The mid-support arrangement 50 comprises a first lateral mid-support member 503 laterally extended between two inner ends of the first and second longitudinal side reinforcing members 2011, 2021 along an inner lateral side portion of the second top unit 104, and a second lateral mid-support member 502 laterally extended between two inner ends of another first and second longitudinal side reinforcing members 2012, 2022 along an inner lateral side portion of the first top unit 103. Preferably, the first lateral mid-support member 503 is coupled with two corresponding first connectors 602 at the inner ends of the first and second longitudinal side reinforcing members 2011, 2021 while the second lateral mid-support member 502 is coupled with two corresponding first connectors 601 at the inner ends of the first and second longitudinal side reinforcing members 2012, 2022. The torsion resistance frame 20 further comprises two lateral side reinforcing members 203, 204 which are laterally extended between the outer ends of the first and second longitudinal side reinforcing members 2011, 2012, 2021, 2022 and are extended parallelly to the first and second lateral mid-support members 503, 502. Each of the leg frames 30 comprises a rotating member 301 rotatably coupling with the corresponding lateral side reinforcing member 203, 204, wherein the rotating member 301 is coaxially coupling with the corresponding lateral side reinforcing member 203, 204 to enable the rotating member 301 being rotated with respect to the lateral side reinforcing member 203, 204. The mid-support arrangement 50 further comprises a first longitudinal mid-support member 5011 extended between the corresponding lateral side reinforcing member 203, 204 and the first lateral mid-support member 503 at the first top unit 103, and a second longitudinal mid-support member 5012 extended between the corresponding lateral side reinforcing member 203 and the second lateral mid-support member 502 at the second top unit 104. Preferably, the first and second longitudinal mid-support members 5011, 5012 are positioned at the middle of the first and second longitudinal side reinforcing members 2011, 2012, 2021, 2022. In addition, each of the rotating members 301 has a receiving groove 3011 provided at the mid-portion thereof such that when the rotating members 301 are rotatably coupled with the lateral side reinforcing members 203, 204 respectively, the first and second longitudinal mid-support members 5011, 5012 can connect to the corresponding lateral side reinforcing members 203, 204 at the receiving grooves 3011 of the rotating members 301. Accordingly, the leg folding arrangement 40 is operatively coupled between each of the leg frames 30 with the corresponding first and second longitudinal mid-support member 5011, 5012.

Each of the leg frames 30 further comprises two supporting legs 302 downwardly and spacedly extended from table top 10. The leg folding arrangement 40 comprises a table connector 401 and a leg connector 402 pivotally coupling with the table connector 401. The table connector 401 has one end pivotally coupled with one of the first and second longitudinal mid-support members 5011, 5012 and an opposed end pivotally coupled with the leg connector 402. The leg connector 402, having a Y-shaped configuration, has one end pivotally coupled with the table connector 401 and two corresponding ends pivotally coupled with the supporting legs 302 respectively. Therefore, when the table connector 401 is pivotally folded to overlap with the leg connector 402, the supporting legs 302 of the leg frame 30 can be pivotally folded on the bottom side of the table top 10 and when the table connector 401 is pivotally folded to extend the leg connector 402 end-to-end, the supporting legs 302 can be pivotally fold to transversely extend from the table top 10. The leg folding arrangement 40 further comprises a lock unit 403 for releasably locking the table connector 401 with the leg connector 402 to lock up the pivotal movement between the table connector 401 and the leg connector 402.

The lock unit 403 comprises a positioning member 4031 and a lock member 4032 cooperatively engaging with the table connector 401 and the leg connector 402 in the open position. The table connector 401 is pivotally connected to the leg connector 402 to define an overlapping connecting portion between the table connector 401 and the leg connector 402 at the unfolded position. The positioning member 4031 of the lock unit 403 having a positioning hole 4033 is positioned on the overlapping connecting portion of the table connector 401 and the leg connector 402. In particular, the positioning member 4031 of the lock unit 403 slidably encloses the overlapping connecting portion of the table connector 401 and the leg connector 402. The table connector 401 has an elongated groove 4034 corresponding to the position of the positioning hole 4033. The leg connector 402 has a U-shaped groove 4035 corresponding to the position of the elongated groove 4034 of the table connector 401 and the positioning hole 4033 of the positioning member 4031 of the lock unit 403, such that when the positioning hole 4033 of the lock unit 403; the elongated groove 4034 of the table connector 401 and the U-shaped groove 4035 of the leg connector 402 are aligned and overlapped to form a lockable through hole, the lock member 4032 penetrating the lockable through hole locks the position of the table connector 401, the leg connector 402 and the lock unit 403 such that the relative movement of the table connector 401 and the leg connector 402 is restricted. That is to say, the table connector 401 and the leg connector 402 are locked securely by the lock unit 403 in the unfolded position.

According to the first preferred embodiment of the present invention, the structure of the torsion resistance frame 20 is described. The first and second top units 103, 104 of the table top 10 are supported by the torsion resistance frame 20, wherein the first and second longitudinal side reinforcing members 2011, 2012, 2021, 2022 are parallelly extended with each other and are longitudinally extended along two longitudinal side portions of the first and second top units 103, 104 at the bottom side thereof to reinforce the table top 10 at two longitudinal sides thereof. The lateral side reinforcing members 203, 204 are laterally extended between the outer ends of the first and second longitudinal side reinforcing members 2011, 2012, 2021, 2022, wherein the lateral side reinforcing members 203, 204 not only reinforce the two outer lateral sides of the table top 10 but also enable the rotating members 301 being rotatably coupled underneath the table top 10. Accordingly, when the rotating members 301 are rotatably coupled with the lateral side reinforcing members 203, 204 respectively, the first and second longitudinal mid-support members 5011, 5012 can connect to the lateral side reinforcing members 203, 204 at the receiving grooves 3011 of the rotating members 301. The first and second top units 103, 104 of the table top 10 are foldably coupled with each other through the tabletop folding arrangement 60. Accordingly, the first and second longitudinal side reinforcing members 2011, 2012, 2021, 2022 are pivotally connected end-to-end through the tabletop folding arrangement 60, such that the table top 10 can be pivotally folded in half by overlappedly folding the first and second top units 103, 104 with each other. In addition, the first and second lateral mid-support members 503, 504 are laterally extended between two inner ends of the first and second longitudinal side reinforcing members 2011, 2021, 2012, 2022 at a position that the first and second lateral mid-support members 503, 504 are laterally extended along the two inner lateral sides of the table top 10 to reinforce the structure of the table top 10.

Figure 3:
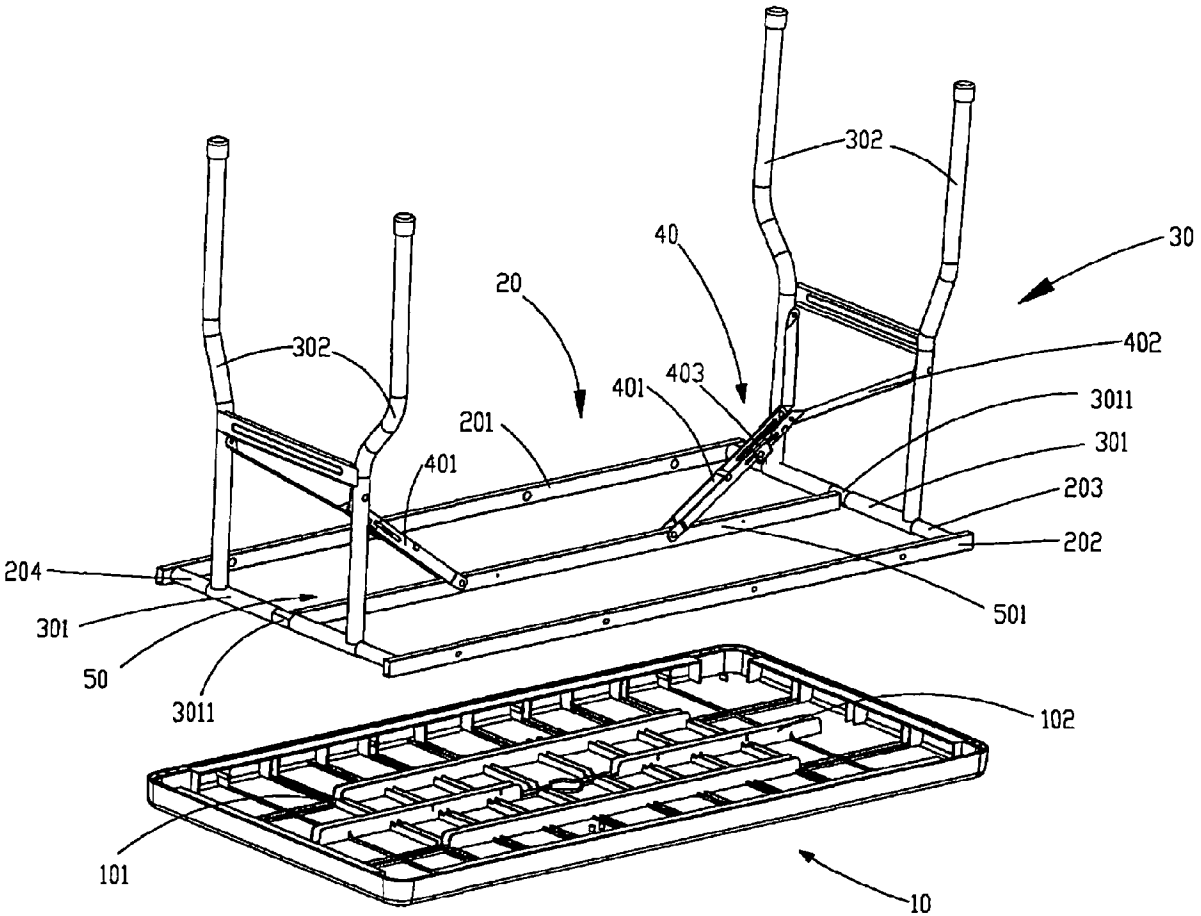
FIG. 3 is an exploded perspective view of the foldable table with anti-torsion arrangement according to a second preferred embodiment of the present invention.
Figure 4:
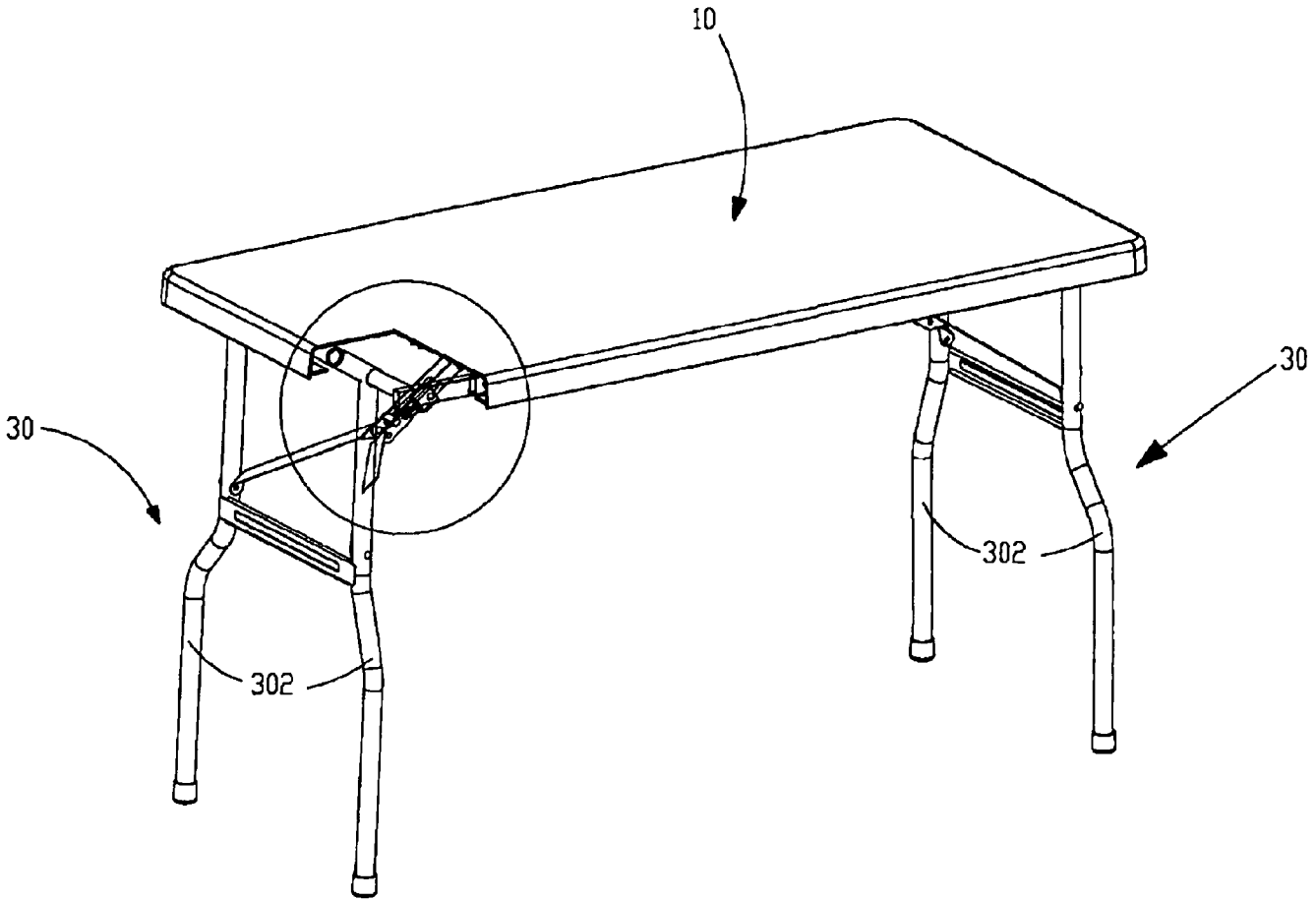
FIG. 4 is a top perspective view of the foldable table with anti-torsion arrangement according to the second preferred embodiment of the present invention.
Figure 5:
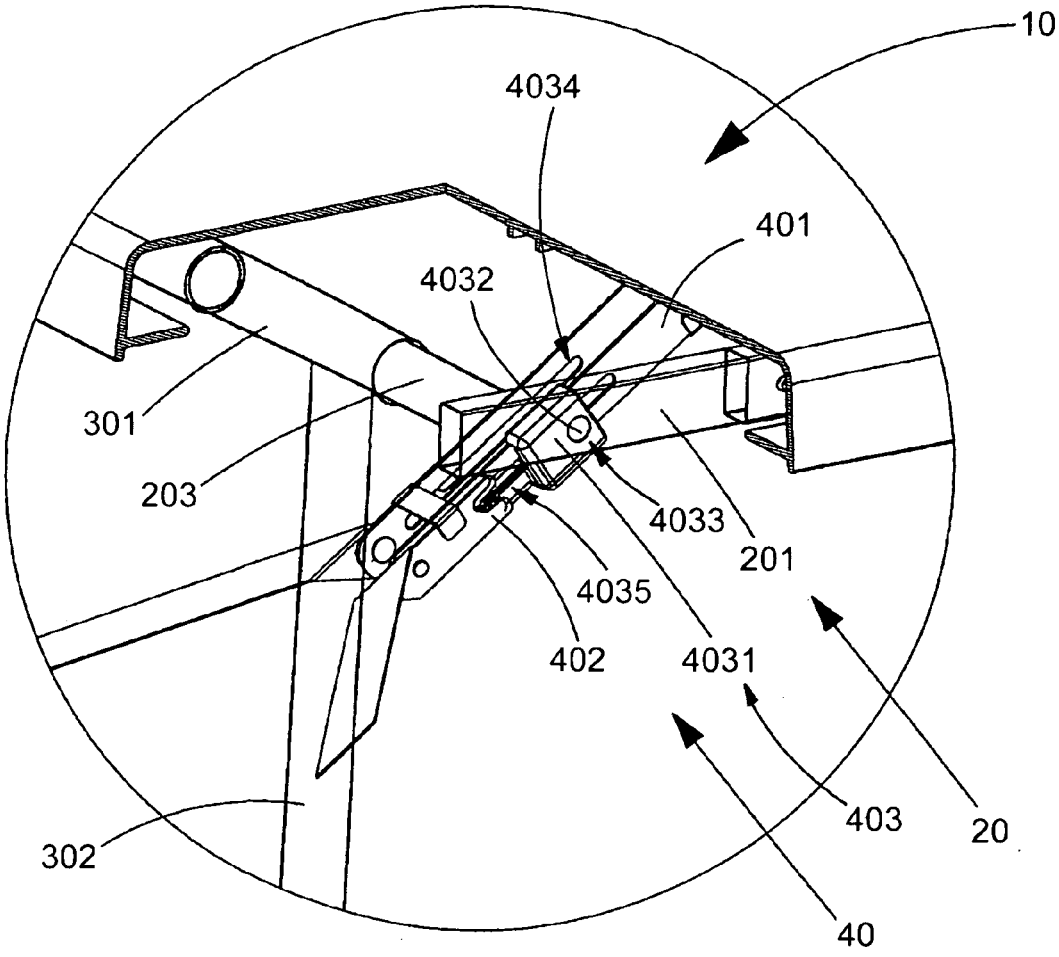
FIG. 5 is a perspective view of the leg folding arrangement of the foldable table with anti-torsion arrangement according to the second preferred embodiment of the present invention.

As shown in FIGS. 3, 4, and 5, a foldable table according to a second embodiment illustrates an alternative mode of the first embodiment.

The foldable table according to the second embodiment comprises a table top 10, a leg frame 30 supported underneath the table top 10, a leg folding arrangement 40 provided between the table top 10 and the leg frame 30 to guide the leg frame 30 being folded between a folded position and an unfolded position, and a torsion resistance frame 20 rigidly coupled at the table top 10 for resisting to the external force of torsion exerted at the table top 10.

Each of the leg frames 30 further comprises two supporting legs 302 downwardly and spacedly extended from table top 10. The mid-support arrangement 50 comprises a longitudinal mid-support member 501 longitudinally extended along a mid-portion of the table top 10 at the bottom side thereof. The leg folding arrangement 40 comprises a table connector 401 and a leg connector 402 pivotally coupling with the table connector 401. The table connector 401 has one end pivotally coupled with the longitudinal mid-support member 501 and an opposed end pivotally coupled with the leg connector 402. The leg connector 402, having a Y-shaped configuration, has one end pivotally coupled with the table connector 401 and two corresponding ends pivotally coupled with the supporting legs 302 respectively. Therefore, when the table connector 401 is pivotally folded to overlap with the leg connector 402, the supporting legs 302 of the leg frame 30 can be pivotally folded on the bottom side of the table top 10 and when the table connector 401 is pivotally folded to extend the leg connector 402 end-to-end, the supporting legs 302 can be pivotally fold to transversely extend from the table top 10. The leg folding arrangement 40 further comprises a lock unit 403 for releasably locking the table connector 401 with the leg connector 402 to lock up the pivotal movement between the table connector 401 and the leg connector 402.

The lock unit 403 comprises a positioning member and a lock member cooperatively engaging with the table connector 401 and the leg connector 402 in the open position. The table connector 401 is pivotally connected to the leg connector 402 to define an overlapping connecting portion between the table connector 401 and the leg connector 402 at the unfolded position. The positioning member of the lock unit 403 having a positioning hole is positioned on the overlapping connecting portion of the table connector 401 and the leg connector 402. In particular, the positioning member of the lock unit 403 slidably encloses the overlapping connecting portion of the table connector 401 and the leg connector 402. The table connector 401 has an elongated groove corresponding to the position of the positioning hole. The leg connector 402 has a U-shaped groove corresponding to the position of the elongated groove of the table connector 401 and the positioning hole of the positioning member of the lock unit 403, such that when the positioning hole of the lock unit 403, the elongated groove of the table connector 401 and the U-shaped groove of the leg connector 402 are aligned and overlapped to form a lockable through hole, the lock member penetrating the lockable through hole locks the position of the table connector 401, the leg connector 402 and the lock unit 403 such that the relative movement of the table connector 401 and the leg connector 402 is restricted. That is to say, the table connector 401 and the leg connector 402 are locked securely by the lock unit 403 in the unfolded position.

The torsion resistance frame 20 comprises two longitudinal side frames provided two longitudinal side portions of the table top 10 at the bottom side thereof respectively, wherein each of the longitudinal side frames comprises a longitudinal side reinforcing member 201, 202 extended along the respective longitudinal side portion of the table top 10. The torsion resistance frame 20 further comprises two lateral side reinforcing members 203, 204 which are laterally extended between the outer ends of the longitudinal side reinforcing members 201, 204 at the lateral side portions of the table top 10. Preferably, the lateral side reinforcing members 203, 204 are perpendicularly extended between the outer ends of the longitudinal side reinforcing members 201, 204 to form a rectangular anti-torsion frame for encircling with the peripheral portion of the table top 10. Each of the leg frames 30 comprises a rotating member 301 rotatably coupling with the corresponding lateral side reinforcing member 203, 204, wherein the rotating member 301 is coaxially coupling with the corresponding lateral side reinforcing member 203, 204 to enable the leg frame 30 being rotated with respect to the lateral side reinforcing member 203, 204.

The torsion resistance frame 20 further comprises a mid-support arrangement 50.

The mid-support arrangement 50, which is longitudinally extended at a mid-portion of the table top 10, comprises a longitudinal mid-support member 501 extended between the corresponding lateral side reinforcing members 203, 204 to reinforce the table top 10 at the mid-portion thereof. Each of the rotating members 301 has a receiving groove 3011 provided at the mid-portion thereof such that when the rotating members 301 are rotatably coupled with the lateral side reinforcing members 203, 204 respectively, the longitudinal mid-support member 501 can connect to the corresponding lateral side reinforcing members 203, 204 at the receiving grooves 3011 of the rotating members 301.

Figure 6:
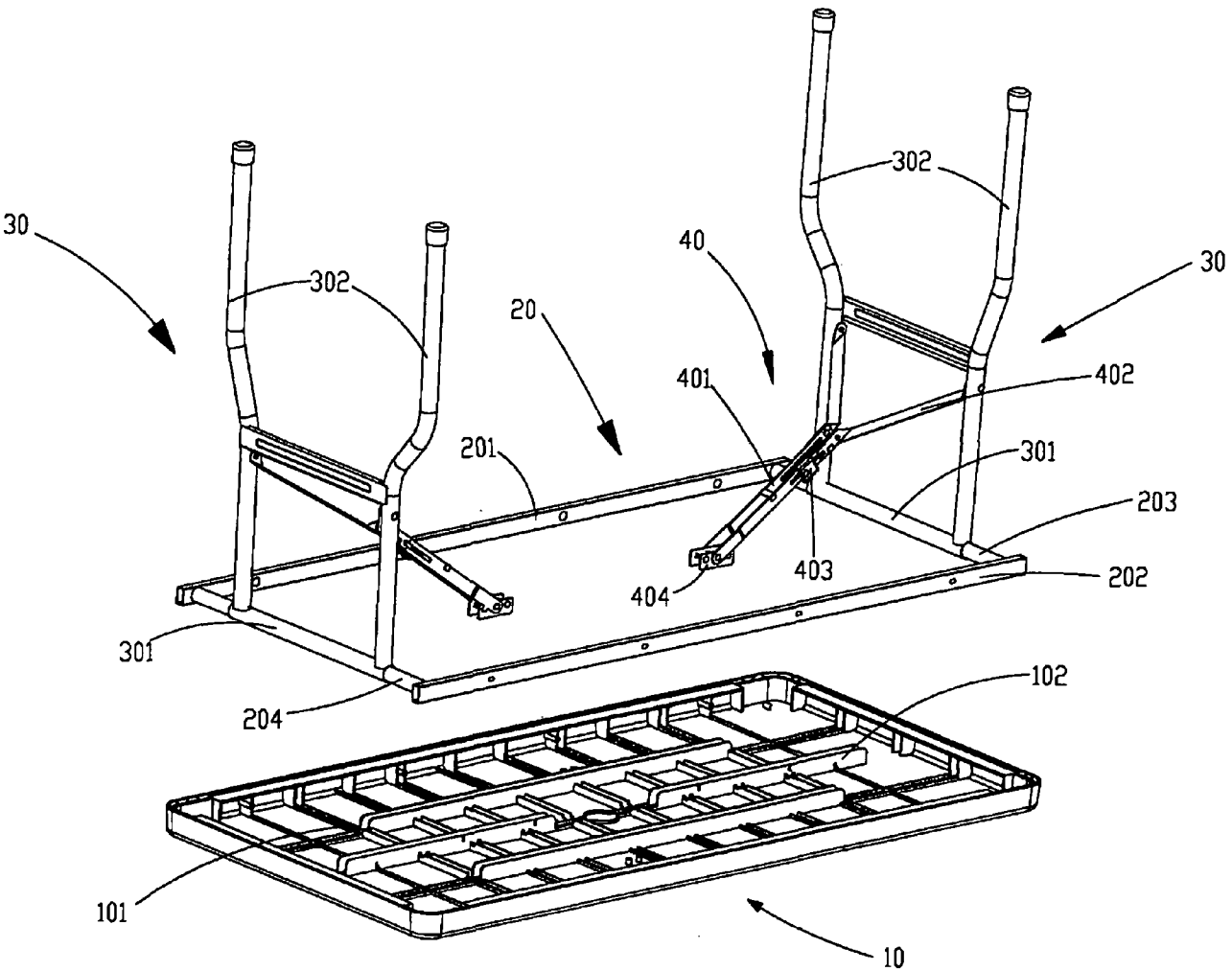
FIG. 6 is an exploded perspective view of the foldable table with anti-torsion arrangement according to a third preferred embodiment of the present invention.
Figure 7:
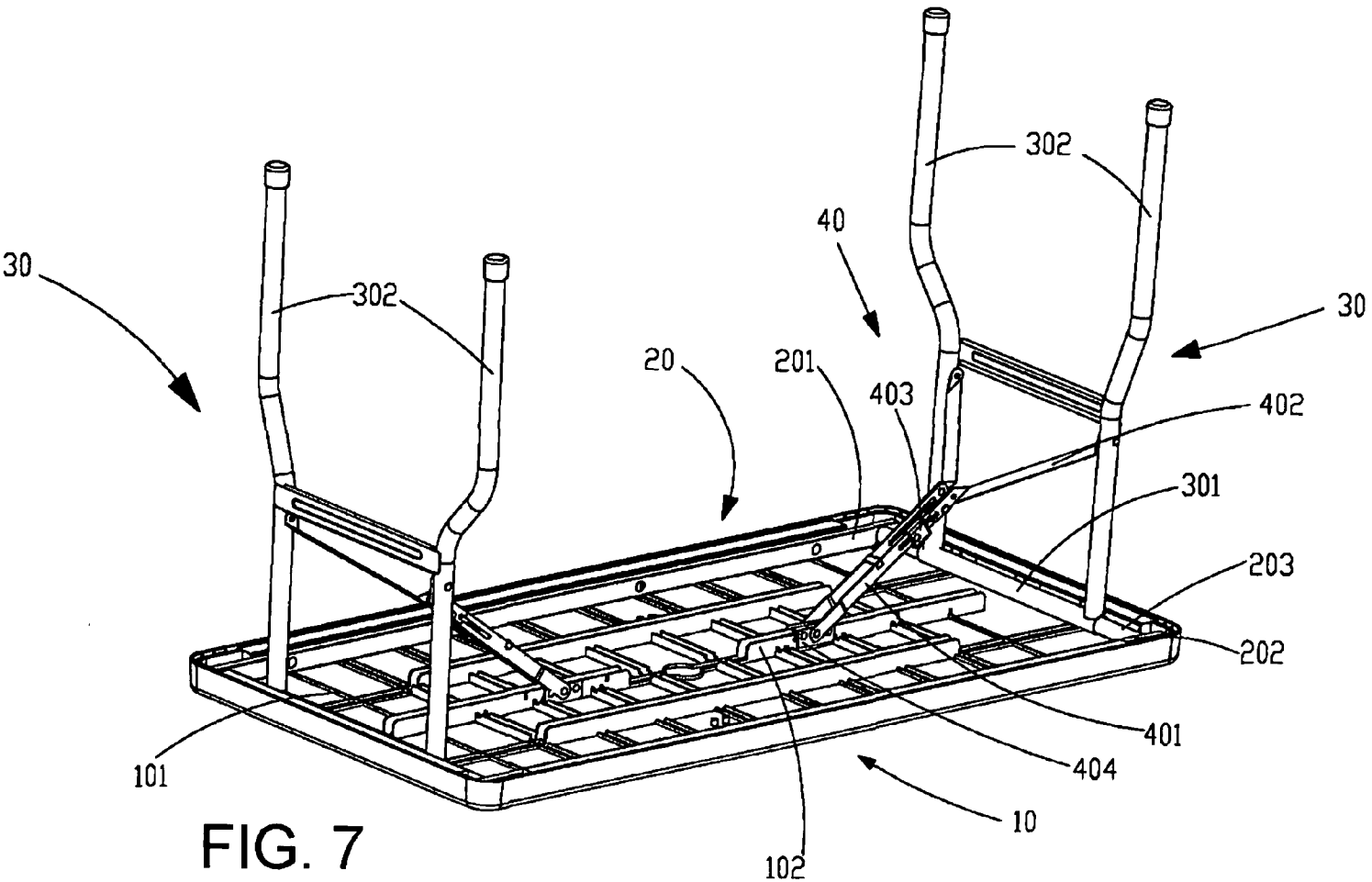
FIG. 7 is a bottom perspective view of the foldable table with anti-torsion arrangement according to the third preferred embodiment of the present invention.

As shown in FIGS. 6 and 7, a foldable table according to a third embodiment illustrates an alternative mode of the first embodiment.

The foldable table according to the second embodiment comprises a table top 10, a leg frame 30 supported underneath the table top 10, a leg folding arrangement 40 provided between the table top 10 and the leg frame 30 to enable the leg frame 30 being folded between a folded position and an unfolded position, and a torsion resistance frame 20 rigidly coupled at the table top 10 for resisting to the external force of torsion exerted at the table top 10.

Each of the leg frames 30 further comprises two supporting legs 302 downwardly and spacedly extended from table top 10. The leg folding arrangement 40 comprises a table connector 401 and a leg connector 402 pivotally coupling with the table connector 401. The table connector 401 has one end pivotally coupled with the bottom side of the table top 10 via a base connector 404 and an opposed end pivotally coupled with the leg connector 402. Accordingly, the base connector 404 is affixed to the bottom side of the table top 10. The leg connector 402, having a Y-shaped configuration, has one end pivotally coupled with the table connector 401 and two corresponding ends pivotally coupled with the supporting legs 302 respectively. Therefore, when the table connector 401 is pivotally folded to overlap with the leg connector 402, the supporting legs 302 of the leg frame 30 can be pivotally folded on the bottom side of the table top 10 and when the table connector 401 is pivotally folded to extend the leg connector 402 end-to-end, the supporting legs 302 can be pivotally fold to transversely extend from the table top 10. The leg folding arrangement 40 further comprises a lock unit 403 for releasably locking the table connector 401 with the leg connector 402 to lock up the pivotal movement between the table connector 401 and the leg connector 402.

The lock unit 403 comprises a positioning member and a lock member cooperatively engaging with the table connector 401 and the leg connector 402 in the open position. The table connector 401 is pivotally connected to the leg connector 402 to define an overlapping connecting portion between the table connector 401 and the leg connector 402 at the unfolded position. The positioning member of the lock unit 403 having a positioning hole is positioned on the overlapping connecting portion of the table connector 401 and the leg connector 402. In particular, the positioning member of the lock unit 403 slidably encloses the overlapping connecting portion of the table connector 401 and the leg connector 402. The table connector 401 has an elongated groove corresponding to the position of the positioning hole. The leg connector 402 has a U-shaped groove corresponding to the position of the elongated groove of the table connector 401 and the positioning hole of the positioning member of the lock unit 403, such that when the positioning hole of the lock unit 403, the elongated groove of the table connector 401 and the U-shaped groove of the leg connector 402 are aligned and overlapped to form a lockable through hole, the lock member penetrating the lockable through hole locks the position of the table connector 401, the leg connector 402 and the lock unit 403 such that the relative movement of the table connector 401 and the leg connector 402 is restricted. That is to say, the table connector 401 and the leg connector 402 are locked securely by the lock unit 403 in the unfolded position.

The torsion resistance frame 20 comprises two longitudinal side frames provided two longitudinal side portions of the table top 10 at the bottom side thereof respectively, wherein each of the longitudinal side frames comprises a longitudinal side reinforcing member 201, 202 extended along the respective longitudinal side portion of the table top 10. The torsion resistance frame 20 further comprises two lateral side reinforcing members 203, 204 which are laterally extended between the outer ends of the longitudinal side reinforcing members 201, 204. Preferably, the lateral side reinforcing members 203, 204 are perpendicularly extended between the outer ends of the longitudinal side reinforcing members 201, 204 to form a rectangular anti-torsion frame to encircle with the peripheral portion of the table top 10. Each of the leg frames 30 comprises a rotating member 301 rotatably coupling with the corresponding lateral side reinforcing member 203, 204, wherein the rotating member 301 is coaxially coupling with the corresponding lateral side reinforcing member 203, 204 to enable the rotating member 301 being rotated with respect to the lateral side reinforcing member 203, 204.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A foldable table, comprising:

a plastic made table top having a plurality of pre-arranged indentation grooves provided at a bottom side of said table top, wherein said table top comprises a first top unit and a second top unit identical to said first top unit;

two leg frames foldably coupling with said bottom side of said table top between a folded position and an unfolded position, wherein each of said leg frames comprises a rotating member; and a torsion resistance frame rigidly coupled at said bottom side of said table top for resisting to an external force of torsion exerted at said table top, wherein said torsion resistance frame, which is embedded into indentation grooves of said bottom side of said table top, comprises:

two longitudinal side frames embedded in said bottom side of said table top and parallelly provided along two longitudinal side portions of said table top at said bottom side thereof respectively, wherein each of said longitudinal side frames comprises first and second longitudinal side reinforcing members embedded into said bottom sides of said first and second top units respectively;

two lateral side reinforcing members which are embedded in said bottom side of said table top and are laterally extended between outer ends of said first and second longitudinal side reinforcing members of said longitudinal side frames at two lateral side portions of said table top to form an anti-torsion frame embedded in said bottom side of said table top and encircled with a peripheral portion of said table top, so as to increase the rigidity of said table top for preventing said table top from distortion;

a mid-support arrangement longitudinally extended at a mid-portion of said table top, wherein said mid-support arrangement comprises a first lateral mid-support member laterally extended between two inner ends of said first and second longitudinal side reinforcing members along an inner lateral side portion of said first top unit, and a second lateral mid-support member laterally extended between two inner ends of another said first and second longitudinal side reinforcing members along an inner lateral side portion of said second top unit, wherein said first and second lateral mid-support members reinforce said table top at said mid-portion thereof, wherein each of said rotating member rotatably couples with said corresponding lateral side reinforcing member, wherein said rotating member is coaxially coupled with said corresponding lateral side reinforcing member to enable said leg frame being rotated with respect to said lateral side reinforcing member, wherein each of said rotating members has a receiving groove provided at a mid-portion thereof such that when said rotating members are rotatably coupled with said lateral side reinforcing members respectively, said longitudinal mid-support member is coupled with said lateral side reinforcing members at said receiving grooves of said rotating members;

a tabletop folding arrangement pivotally coupling said first and second longitudinal side reinforcing members end-to-end to enable said first top unit being pivotally folded to overlap with said second top unit, wherein said tabletop folding arrangement comprises a first connector provided at said inner end of each of said first and second longitudinal side reinforcing members and a second connector pivotally coupling two said corresponding first connectors with each other so as to pivotally connect said first and second longitudinal side reinforcing members end-to-end, wherein said first lateral mid-support member is coupled with said two corresponding first connectors at said inner ends of said first and second longitudinal side reinforcing members, wherein said second lateral mid-support member is coupled with said two corresponding first connectors at said inner ends of said first and second longitudinal side reinforcing members; and a leg folding arrangement to guide said leg frames being folded between said folded position and said unfolded position, wherein said leg folding arrangement comprises a table connector, and a leg connector pivotally coupling with said table connector, and means for locking up a rotatable movement between said rotating member and said lateral side reinforcing member, wherein said locking means comprises a positioning member and a lock member, wherein said positioning member has a positioning hole positioned at an overlapping connecting portion of said table connector and said leg connector at said unfolded position, wherein said table connector has an elongated groove corresponding to a position of said positioning hole, wherein said leg connector has a U-shaped groove corresponding to a position of said elongated groove of said table connector and said positioning hole of said positioning member, wherein when said positioning hole, said elongated groove, and said U-shaped groove are aligned and overlapped to form a lockable through hole, said lock member penetrates said lockable through hole to lock up said table connector and said leg connecter at said unfolded position.

2. The foldable table, as recited in claim 1, wherein said table connector is pivotally coupled with said longitudinal mid-support member at said bottom side of said table top.

3. The foldable table, as recited in claim 1, wherein said table connector is pivotally coupled with a base connector at said bottom side of said table top.

4. The foldable table, as recited in claim 1, wherein said table connector has one end pivotally coupled at said bottom side of said table top and an opposed end pivotally coupled with the leg connector, wherein said leg connector, having a Y-shaped configuration, has one end pivotally coupled with said table connector and two corresponding ends pivotally coupled with two supporting legs of each of said leg frames respectively.

5. The foldable table, as recited in claim 4, wherein said table connector is pivotally coupled with said longitudinal mid-support member at said bottom side of said table top.

6. The foldable table, as recited in claim 4, wherein said table connector is pivotally coupled with a base connector at said bottom side of said table top.

* * * * *